United States Patent [19]

Hill

[11] 4,038,731

[45] Aug. 2, 1977

[54] FORMING INTEGRATED ROLLER FROM CORE, TELESCOPING SLEEVE AND FILLER ADHESIVE

[76] Inventor: Edward D. Hill, 3140 W. 32nd St., Cleveland, Ohio 44109

[21] Appl. No.: 588,384

[22] Filed: June 19, 1975

[51] Int. Cl.[2] ..... B21B 27/00

[52] U.S. Cl. ..... 29/132

[58] Field of Search ..... 29/132, 130

[56] References Cited

U.S. PATENT DOCUMENTS

| | | | |
|---|---|---|---|
| 1,833,461 | 11/1931 | Grupe | 29/132 |
| 3,184,828 | 5/1965 | Dames | 29/132 |
| 3,401,439 | 9/1968 | Staats | 29/130 |
| 3,646,652 | 3/1972 | Heiligenthal | 29/130 |
| 3,859,701 | 1/1975 | Huber | 29/132 |

*Primary Examiner*—Reinaldo P. Machado
*Attorney, Agent, or Firm*—Westley B. Taylor

[57] ABSTRACT

Molding apparatus for forming a roller, such as a printing roller, and the resulting product are disclosed in which such apparatus includes an elastomeric sleeve and a core, the sleeve telescopically receiving the core and defining therebetween a casting area to receive a settable adhesive. One of the sleeve and core has axially extending grooves on a side facing the other to facilitate substantially even distribution of the liquid adhesive between it and the other member, whereby upon receipt and setting of the adhesive, the sleeve, adhesive and core define an integrated roller of substantially uniformly distributed balance and weight. Preferably, the set adhesive has substantially the same density as the elastomeric sleeve. Optionally, two adhesives may be used, as concentric tubular coatings, one adhesive to coat the core and a second adhesive used in greater amount to coat the sleeve and fill the casting area. The two adhesives are chosen to effect a strong bond between the core and the sleeve, which are of different materials, and between each other such that a strong integrated bond is realized from sleeve-to-core.

16 Claims, 7 Drawing Figures

FORMING INTEGRATED ROLLER FROM CORE, TELESCOPING SLEEVE AND FILLER ADHESIVE

BACKGROUND OF THE INVENTION

Rollers are commonly used in many industries for applying or transferring a coat or covering to a substrate. For example, rollers are used to apply liquid solutions or dispersions of all kinds such as paint, ink, adhesives, hot melts, etc., to various surfaces for decorative or protective purposes. Still other types of application may be effected by rollers, such as the application of an imitation or simulation wood graining to metal surfaces.

In time, the outer surface of a roller becomes sufficiently worn or out-of-round that it is no longer suitable for use. As an economy measure, it has been the practice to recover or reface the roller. The remnant of the original cover is suitably removed as by machining, usually down to a rigid core, and a new outer, cylindrical body is then mounted on what is left.

It is not a simple matter to accomplish this using presently known techniques and obtain a serviceable roller. Skilled labor often is required. One practice has been for a user of a worn roller to ship it to a manufacturer of rollers who recovers the roller and then re-ships it back to the user. Since the core of the roller is usually of solid metal, and a worn roller of a large type employed may weigh upwards of 400 pounds, shipping the roller back and forth, plus the cost of repair, as well as the delay until the roller is again available for use, all combine to make the recovering of a roller an expensive and time-consuming operation.

SUMMARY OF THE INVENTION

A leading object of the present invention is to provide apparatus for placing a roller body about a supporting core and, more particularly, such apparatus, as well as its resulting product, for resurfacing or refacing a worn roller in a rapid, convenient, and inexpensive manner. Use of the apparatus does not require a skilled artisan, such that a user of the roller can carry out repairs at on-site locations with untrained help and thereby avoid the loss of time and expense of shipping the roller away for repair.

In one form, the present invention includes an elastomeric sleeve and a core, the sleeve telescopically receiving the core and defining therebetween an annular casting area which receives a liquid, settable adhesive. One of the sleeve or core has axially extending grooves on a side facing the other to facilitate substantially even distribution of the liquid adhesive means between it and the other part. In this manner, upon setting of the adhesive, the sleeve, adhesive and core define an integrated roller of substantially uniformly distributed balance and weight.

After the roller has been formed, it may if desired be machined by conventional means to an exact final diameter. However, in any case, the performance of the roller in use is materially affected by its weight distribution. When the weight of a roller is not evenly distributed, it "thumps" in operation resulting in poor service and a shortened useful life. The axial extending grooves materially aid in obtaining a proper weight distribution of the adhesive between the sleeve and core. The nature of the adhesive used to fill the annular area between the sleeve and core is not critical and may comprise many different kinds of materials. For reasons of weight distribution as just mentioned, it is preferred for the set adhesive, as hereinafter defined, to be substantially of the same density or molecular weight as the material of the elastomeric sleeve. For example, if the sleeve is a polyurethane, the adhesive may also be a polyurethane which when set has substantially the same molecular weight as that of the sleeve.

The use of a restraining mold in combination with a sleeve and core is also contemplated to limit the expansion of the sleeve and control the addition of the adhesive when it is flowed into the annular area between the sleeve and core.

In order to insure a strong ultimate sleeve-to-core bond, it is preferred to use dual adhesives which when set define concentric tubular coatings between the sleeve and core. In this modification, it is preferred to use a thermoplastic resin as one adhesive to coat the core, and a thermosetting resin formed from a liquid polymerizable resin as a second adhesive to coat the sleeve and fill the annular area between the sleeve and coated core.

DESCRIPTION OF THE PREFERRED EMBODIMENTS

The apparatus of the invention consists, in one form, of an outer elastomeric sleeve and an inner, rigid core placed within the sleeve so as to leave an intervening annular area therebetween. A liquid, settable adhesive fills the area. In order to achieve a substantially even distribution of the adhesive around the core and between it and the sleeve as the adhesive flows into the annular area, at least one of the core and sleeve has axially extending grooves. The sleeve forms part of the ultimate roller that is formed. When set, the adhesive holds the sleeve and core in integrated assembly. The sleeve of the resultant roller may, if necessary or desirable, be subsequently machined to true the roller shape.

Figure 1:
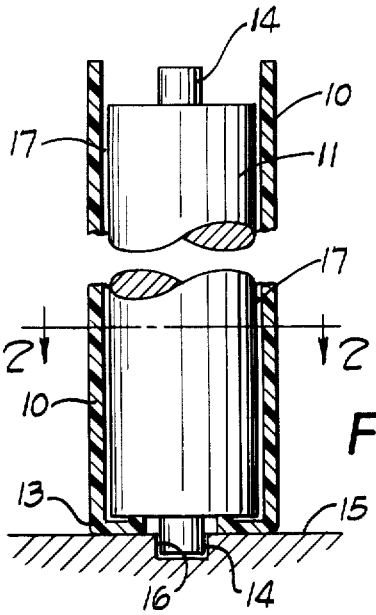
FIG. 1 is a side elevational view of a sleeve and core of one form of the present invention with the sleeve shown in vertical half section.
Figure 2:
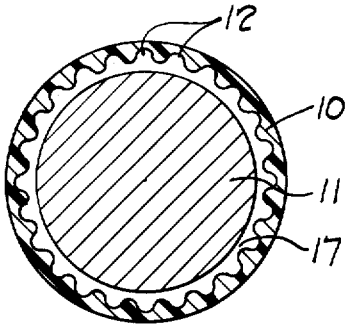
FIG. 2 is a section of FIG. 1 on the line 2—2.

Referring initially to FIGS. 1 and 2, this embodiment comprises an outer elastomeric sleeve 10 telescopically receiving a center core 11. It will be appreciated that the relative radial thicknesses of the sleeve and core may be varied substantially from those used in the drawing to illustrate the invention. Since the core supports the roller during rotation and the like, it is preferably rigid and usually made of metal. On the other hand, sleeve 10 is elastomeric and preferably susceptible to slight stretching in an outward radial direction, especially if used in combination with an outer restricting mold as hereinafter described.

Sleeve 10 may be fabricated from many different elastomeric materials, such as natural rubber, or synthetic plastics or rubbers like butadiene-styrene polymers, butadiene-acrylonitrile polymers, butyl rubber, chlorinated butyl rubber, polyisobutylene, nylon, and the like. However, it is preferred to use elastomers which have properties which adapt them for use as printing rollers. Polyvinyl resins like polyvinyl chloride can be ink-attractive and ink-resistant and have a natural tack. Polyacrylates and polyurethane resins are also useful in printing rollers and can be used in preparing or fabricating sleeve 10. A useful polyurethane for this purpose is disclosed in U.S. Pat. No. 3,387,074 to Hill. Silicone rubbers may also be used for sleeve 10. Such rubbers are relatively hard, provide a long useful life, and have excellent heat resistance. Useful silicone rubbers are described in U.S. Pat. Nos. 3,692,732; 3,696,068; 3,696,090 and 3,701,753. The rubbers of the last two mentioned patents disclose liquid silicone rubber compositions that are vulcanizable at room temperatures. Sleeve 10 can also be fabricated from nylon and epoxy resins as well as from a polyalkylene polysulfide resin disclosed in U.S. Pat. No. 2,538,758 to Hill; or from a polyalkylene polysulfide plasticized with an acrylate resin as disclosed in U.S. Pat. No. 3,318,973 to Hill.

Sleeve 10 is tubular with its outer surface being smooth and even. The inner surface which faces core 11 is fluted as shown in FIG. 2 to define a series of spaced apart grooves 12. The grooves may parallel the axis of core 11 as illustrated, or they may spiral about the core as long as the grooves extend axially to achieve an even distribution of adhesive along core 11. Sleeve 10 may be preformed as by extrusion, static casting, centrifugal casting, fabricated from sheet or film or the like, in relatively long sections. Coils of the prefabricated sleeve 10 can be stored until needed. Then a desired length is cut, either relatively long or relatively short or of an intermediate length, to meet diverse requirements.

Optionally, particularly when shorter lengths of sleeve 10 are preformed, sleeve 10 may be fabricated with a radially inturned flange 13 at one end. In use the telescoping sleeve and core are placed in a vertical position as shown in FIG. 1. Core 11 has a pair of oppositely arranged supporting shaft portions 14 extending outwardly from opposite ends of core 11 for rotatably mounting the core 11 on suitable supports in a known manner. In preparing a roller of the present invention, a base generally represented at 15 has a circular recess 16 to receive a shaft portion 14 in a fairly snug fit. Flange 13 of sleeve 10 seats between base 15 and an end of core 11 to prevent the flow of liquid adhesive from that end of the core. Alternatively, the sealing action can be obtained even if sleeve 11 lacks a preformed flange shown at 13. The elastomeric nature of the sleeve enables an end of it to be tucked between an end of core 11 and base 15. Wrinkling of the tucked portion of the sleeve is not objectionable, since that portion is later cut-away as hereinafter described.

When the sleeve and core are positioned with respect to each other to define an intervening annular area 17 as shown in FIG. 1, a liquid, settable adhesive is flowed into the open end of sleeve 10 to fill completely the annular area. As used here and in the claims, the term "settable" means that the adhesive will set or convert to a solid form. This may be accomplished by the application of heat as for thermosetting materials, or by allowing the adhesive to cool or by the positive subtraction of heat as for thermoplastic materials. Thermosetting materials are usually preferred.

The term "adhesive" or "adhesive means" is used here and in the claims to describe the materials used to fill annular area 17, since it is the prime intent for such materials to stick to both sleeve 10 and core 11 and form a strong bond therebetween. However, it is contemplated that the adhesive may be used in fairly large quantities where area 17 itself may be relatively large, so that the adhesive is also employed in a nature of a filler material. In any case, the adhesive becomes an integral part of the ultimately formed roller.

The nature of the adhesive used is not critical. In a preformed form of the invention, especially when the roller is to be used at a relatively high rate of rotation, the adhesive as set has substantially the same density as the material of sleeve 10; for example, the adhesive may have the same molecular weight as the sleeve. This tends to avoid an unbalanced weight with resultant thumping or eccentricity during rotation. In one practice of the invention, the adhesive may be of the same material that constitutes sleeve 10. For example, the adhesive can be formed by reaction of a polyethylene glycol, a polyol, and an isocyanate compound as described in U.S. Pat. No. 3,475,803 to Hill for use with a polyurethane sleeve. Or the adhesive may comprise a curable mixture of a cross-linking silicone resin and a silane as described in U.S. Pat. No. 3,225,419 to Milton et al.

In general, the adhesive may comprise any thermoplastic or thermosetting material, natural or synthetic, which adheres to some degree to both sleeve 10 and core 11. Where the adhesive is to be used as a liquid, the polymeric growth of such material is so insufficiently advanced that it is still a liquid at room temperatures. Useful thermoplastic adhesives include cellulose acetate, fluorocarbons such as polytetrafluoroethylene, nylon, polyethylene, polypropylene, polystyrene, polyvinyl chloride, polyvinyl acetate, polyvinylidene chloride, polyvinyl butyral, polyvinyl alcohol, copolymers of such vinyl polymers, the polyacrylates such as polymethacrylate, linear polyesters, and the like. Useful thermosetting adhesives include phenol-formaldehyde, phenol-furfural, melamine-formaldehyde, urea formaldehyde, cross-linked polyesters, epoxy resins, and the like. Polyacrylates and epoxy resins preferred for this purpose are disclosed in U.S. Pat. No. 3,673,040 to Hill. A polyalkylene polysulfide plasticized with an acrylate resin, as disclosed in U.S. Pat. No. 3,318,973 to Hill, may also be used.

It is within the contemplation of the invention to add other ingredients to the adhesives, such as catalysts known in the art to hasten the polymerization of the thermosetting polymerizable adhesives. For example, from about 1 to about 5% by weight of a thermosetting adhesive may comprise m-dinitrobenzene.

After the adhesive has set, those portions of sleeve 10 (and any set adhesive) extending beyond either end of core 11 is cut away and, if desired, the outer surface of the formed roller may be machined to provide a true surface. In this manner, in forming new rollers over old or reclaimed cores, it is possible to effect a great saving in shafting material, for the desired true surface is realized simply by machining only the outer surface of the roller.

Figure 3:
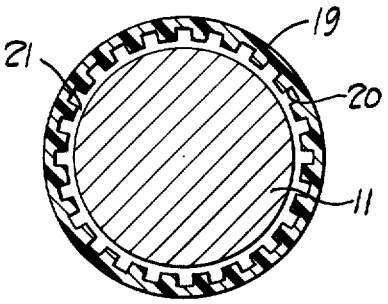
FIGS. 3 and 4 are cross-sections similar to FIG. 2 and illustrate other types of grooves which a sleeve may have.
Figure 4:
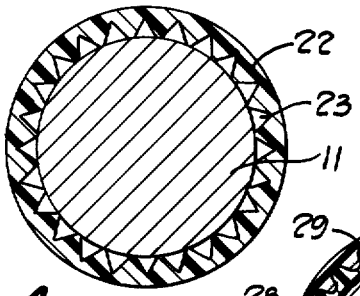
Figure 5:
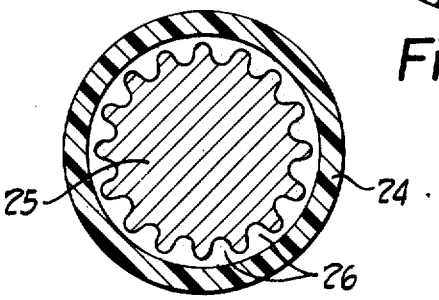
FIG. 5 is a cross-section similar to FIG. 2 but shows the grooves in the core instead of in the elastomeric sleeve.

FIGS. 3, 4, and 5 illustrate that the grooves may take different cross-sectional shapes and need not be on the sleeve. In FIG. 3, a sleeve 19 telescopically receives a core 11 as before, but its grooves 20 are polygonal in cross-section, essentially a square being shown in FIG. 3. Grooves 20 may lie in strict parallelism with the axis of core 11 or spiral around it as previously mentioned. Sleeve 19 is spaced from core 11 to leave an intervening casting area 21 which includes the volume of the grooves 20.

In FIG. 4, a sleeve 22 again telescopically receives a core 11 and has grooves 23 which are essentially of triangular cross-section. Further, the points or ridges on either side of grooves 23 contact core 11 such that the intervening area between sleeve 22 and core 11 of FIG. 4 is essentially the volume of grooves 23. The construction of FIG. 4 in which the ridges on either side of grooves 23 contact the core aids in centering the sleeve and core with respect to each other.

It is not necessary for the grooves to be in the sleeve. In FIG. 5, a sleeve 24 telescopically receives a core 25, but the sleeve is smooth on both of its curved faces. Core 25, however, has axially extending grooves 26 which are shown as of fluted configuration but which can have any other configuration shown or still other cross-sectional shapes.

Figure 6:
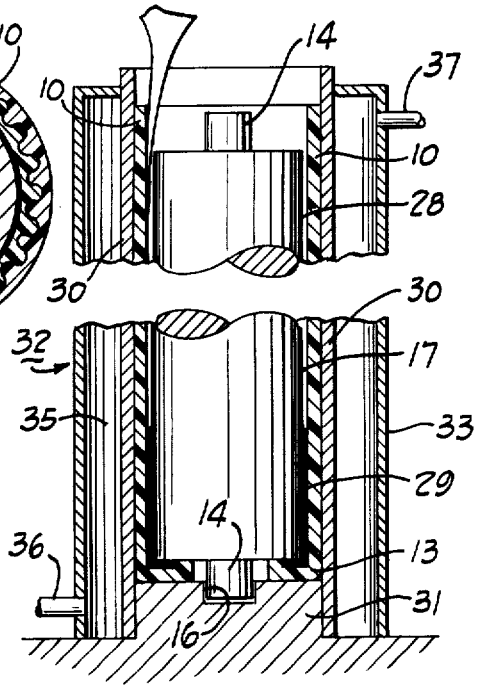
FIG. 6 is a side elevational view similar to FIG. 1 and illustrates the use of dual adhesives, the addition of an outer, restraining mold about the sleeve and apparatus for setting adhesives.

FIG. 6 illustrates a number of further modifications of the present invention, any one of which can be used alone or in combination with one or more of the other modifications. In the preferred practice of the invention, not one but two adhesives are used which, when set, define dual, substantially concentric adhesive coats. Also, a mold member may be used to encompass the sleeve and core and limit outward radial expansion of the sleeve. Finally, the sleeve and core may be equipped with attendent means to set the adhesive. In the case of thermosetting adhesives, such means may take the form of an oven; and in the case of thermoplastic adhesives, such means may take the form of a cooler.

Figure 7:
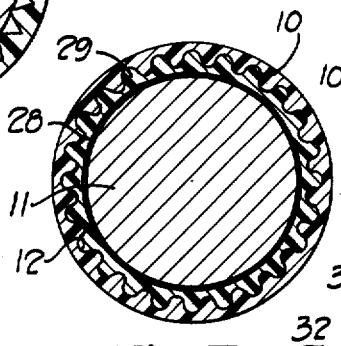
FIG. 7 is a cross-section of a roller produced from the sleeve and core of FIG. 6 and shows the presence of dual adhesives between those parts to bond them into an integrated assembly.

Considering these modifications in greater detail and referring to FIGS. 6 and 7, in one form of the present invention, two different adhesives are used. One is used on the core and one on the sleeve. The latter is also intended to fill the casting area between the core and sleeve. Adhesives are chosen which effect good bonding characteristics to the parts to which they are applied as well as to each other and therefore which effect a strong, tenacious bond from sleeve-to-core. It has been found that good results are achieved when the adhesive coating the core is thermoplastic, and the remaining adhesive is thermosetting, although this need not necessarily be the case.

For example, in this form, the thermoplastic adhesive is applied as a hot melt to the core and allowed to solidify before the core is assembled within the sleeve. The resin is first heated to a temperature sufficient to convert it to a hot melt and then coated on the shaft in any convenient manner. The resin can be allowed, for example, to run down the shaft while it is turning; or the shaft can be dipped in the melted resin which is then allowed to drain from the shaft to leave a substantially uniform coat; or the melt can be wiped on the shaft, etc.

After the sleeve and core are assembled, the thermosetting adhesive is added, preferably as a polymerizable, liquid adhesive, and the polymerization of this adhesive completed after the annular casting area has been filled by it. The thermoplastic adhesive and the thermosetting adhesives may be any of those previously described as an adhesive that may fill the casting area between the sleeve and core.

In FIG. 6, sleeve 10 and core 11 are again shown in telescoping, assembled relation with shaft portion 14 of the core seated in circular recess 16 of supporting base 15. The adhesive coating the core is represented at 28, and the adhesive for the intervening casting area 17 is indicated at 29 at a stage during which it has partially filled that area. FIG. 7 is a cross-section of a roller produced by the dual-adhesive system of FIG. 6 in which the adhesive coats 28 and 29 appear substantially as dual, concentric tubular coats.

Reverting to other modifications of the embodiment of FIG. 6, the addition of an adhesive sometimes has the tendency to expand the sleeve radially. This is not necessarily undesirable and can be used as an aid in shaping the the roller as long as the radial expansion is controlled. In FIG. 6, a rigid, tubular column 30, fabricated for example from steel, controls such expansion by encompasing both core 10 and sleeve 11 and defining the outer most expansion permitted to sleeve 11. In order to center the parts, support base 15 has a circular boss 31 having a diameter which snuggly fits the inside of column 30. Circular recess 16 is at the center of boss 15 so that all parts are aligned concentrically. In this manner, column 30 prevents over expansion, localized balloning, and the like of sleeve 10. In place of column 30, a wrapping of cloth or metal band may be spiraled around sleeve 10 with edges overlapping to form a restraint to expansion of the sleeve in excess of a predetermined amount.

Some thermosetting adhesives set at room temperature and have a fairly short pot life, for example, 10 to 25 minutes. Thermoplastic adhesives set merely upon cooling. However, it is also within the contemplation of the present invention to include apparatus to set an adhesive between the sleeve and core, whether one or two adhesives are used and whether the adhesive is thermosetting or thermoplastic. This apparatus may take the form of a hollow jacket shown generally at 32 in FIG. 6. In the illustrated embodiment, jacket 32 uses column 30 as an inner wall from which an outer wall 33 is spaced to form an enclosed area 35. But the restraining column 30 need not be used in providing for a jacket like jacket 32. A fluid is passed through inlet tube 36 on the jacket and exits at outlet tube 37. For thermosetting adhesives, the fluid may be steam or any heated fluid medium; for thermoplastic adhesives the fluid may be cooling water or any relatively cooler fluid medium.

The rollers produced in accordance with the invention may be used for any purpose rollers are normally employed, such as transfer rollers, power-driven or power-transfer rollers, etc. However, inking rollers such as printing and graining rollers are especially contemplated.

Although the foregoing discloses several embodiments of the present invention, it is understood that the invention may be practiced in still other forms within the scope of the following claims.

I claim:

1. In combination: an elastomeric sleeve member expandable in an outward radial direction and a core member, said sleeve member telescopically receiving the core member and defining therebetween a casting area to receive liquid, dual, concentric tubular adhesive coats that are settable, one of said sleeve and core members having axially extending grooves on a side facing the other member to facilitate substantially even distribution of said liquid adhesive coats between it and said other member, said sleeve member and at least the outer of said tubular adhesive coats, when set, having densities so marginally close that upon receipt and setting of said adhesive coats, the sleeve member, set coats, and core member define integrated roller means of substantially uniformly distributed balance and weight and adapted to avoid thumping in use.

2. The combination of claim 1 in which said sleeve member has the axially extending grooves on a side facing the core member.

3. The combination of claim 1 in which said core member has the axially extending grooves on a side facing the sleeve member.

4. The combination of claim 1 in which said sleeve member has an inturned flange adjacent one end to engage said core member and prevent flow of said liquid adhesive means from that end.

5. The combination of claim 1 further including means to support the core member with respect to said sleeve member.

6. The combination of claim 1 in which said core member has shaft means at least at one end and further including seating means to receive said shaft means and support the core member in a vertically disposed position.

7. The combination of claim 1 in which said core member has shaft means at least at one end, and further including seating means to receive said shaft means and support the core member in a vertically disposed position, and said sleeve member has an inturned flange adjacent one end fitted between an end of said core member and said seating means to prevent flow of said liquid adhesive means from said end.

8. The combination of claim 1 including a rigid, circular mold member encompassing said sleeve and core members and limiting outward radial expansion of said sleeve member.

9. The combination of claim 1 in which said core member has shaft means at least at one end and further including seating means to receive said shaft means and support the core member in a vertically disposed position, and in which a rigid, circular mold member encompasses said sleeve and core members and limits outward radial expansion of said sleeve member.

10. A roller of uniform distribution and weight comprising a core member, an elastomeric sleeve member telescopically disposed about the core member and defining an annular area therebetween, one of said sleeve member and core member having axially grooves on a side facing the other member, and dual, concentric tubular adhesive coats filling said annular area, said grooves serving substantially to distribute said adhesive coats uniformly within said annular area, and the densities of said sleeve and at least said outer concentric tubular coat being so marginally cost as to avoid thumping of said roller in use.

11. The roller of claim 10 in which said sleeve member has the axially extending grooves on a side facing the core member.

12. The roller of claim 10 in which said core member has the axially extending grooves on a side facing the sleeve member.

13. The roller of claim 10 in which said dual, concentric tubular adhesive coats comprises a first adhesive coating the core member and a second, different adhesive coating the facing side of the sleeve member and filling the said annular area.

14. The roller of claim 13 in which said first adhesive is a thermoplastic resin, and said second adhesive is a thermosetting resin formed from a liquid polymerizable resin.

15. The roller of claim 10 in which said adhesive of said outer coat is the same material as said sleeve.

16. The roller of claim 10 in which said sleeve is expandable in an outward radial direction.

* * * * *